US007307385B2

(12) United States Patent
Yamamoto et al.

(10) Patent No.: US 7,307,385 B2
(45) Date of Patent: Dec. 11, 2007

(54) BOOST CONTROLLER CAPABLE OF STEP-UP RATIO CONTROL

(75) Inventors: Isao Yamamoto, Kyoto (JP); Kyoichiro Araki, Kyoto (JP); Noboru Kagemoto, Kanagawa (JP)

(73) Assignee: Rohm Co., Ltd. (JP)

( * ) Notice: Subject to any disclaimer, the term of this patent is extended or adjusted under 35 U.S.C. 154(b) by 115 days.

(21) Appl. No.: 11/083,516

(22) Filed: Mar. 18, 2005

(65) Prior Publication Data

US 2005/0231127 A1 Oct. 20, 2005

(30) Foreign Application Priority Data

Mar. 30, 2004 (JP) ..... 2004-098303
Feb. 9, 2005 (JP) ..... 2005-032788

(51) Int. Cl.
*H05B 37/02* (2006.01)

(52) U.S. Cl. ..... 315/224; 315/291; 315/121; 315/77; 315/82

(58) Field of Classification Search ..... 315/291, 315/224, 209 R, 200 A, 158–159, 121, 77, 315/82, 292, 315–316, 312, 119
See application file for complete search history.

(56) References Cited

U.S. PATENT DOCUMENTS 5,734,317 A * 3/1998 Bennett et al. ..... 340/436
5,744,984 A * 4/1998 Drapac et al. ..... 327/89
6,150,802 A * 11/2000 Andrews ..... 323/282
6,316,880 B1 * 11/2001 Broadhurst ..... 315/200 A
6,388,388 B1 * 5/2002 Weindorf et al. ..... 315/169.3
6,759,766 B2 * 7/2004 Hiratsuka et al. ..... 307/110
6,798,177 B1 * 9/2004 Liu et al. ..... 323/222
6,812,672 B2 * 11/2004 Tamai et al. ..... 320/128
6,836,095 B2 * 12/2004 Fogg ..... 320/128
6,870,328 B2 * 3/2005 Tanabe et al. ..... 315/291
2004/0036418 A1 * 2/2004 Rooke et al. ..... 315/77
2005/0104542 A1 * 5/2005 Ito et al. ..... 315/291

FOREIGN PATENT DOCUMENTS

JP 10-215564 8/1998

OTHER PUBLICATIONS

English Abstract for JP 10-215564 dated Aug. 11, 1998.

* cited by examiner

*Primary Examiner*—Douglas W. Owens
*Assistant Examiner*—Chuc Tran
(74) *Attorney, Agent, or Firm*—Cantor Colburn LLP

(57) ABSTRACT

A charge pump circuit boosts a voltage of a battery so as to generate a drive voltage for an LED. A constant current circuit generates a constant current to feed through the LED. A monitoring circuit monitors a cathode potential of the LED, i.e., a voltage across the constant current circuit. A control circuit receives a result of monitoring from the monitoring circuit 110 and increases a step-up ratio of the charge pump circuit when the voltage across the constant current circuit drops below a minimum voltage that guarantees a constant current. The control circuit sets an externally requested constant current value in the constant current circuit. When a change from a large current to a small current is requested, the control circuit returns the step-up ratio of the charge pump circuit to 1.0.

14 Claims, 6 Drawing Sheets

FIG.3

| CURRENT CONTROL | | | | |
|---|---|---|---|---|
| LED SEL | CC1 | CC2 | LED a～d | LED e～f |
| 0 | 0 | 0 | OFF | OFF |
| 0 | 0 | 1 | OFF | 1mA |
| 0 | 1 | 0 | OFF | 10mA |
| 0 | 1 | 1 | OFF | 20mA |
| 1 | 0 | 0 | 15mA | 15mA |
| 1 | 0 | 1 | 1mA | OFF |
| 1 | 1 | 0 | 10mA | OFF |
| 1 | 1 | 1 | 20mA | OFF |

BOOST CONTROLLER CAPABLE OF STEP-UP RATIO CONTROL

BACKGROUND OF THE INVENTION

1. Field of the Invention

The present invention relates to a boost controller that controls a boost circuit for boosting a battery power supply and supplying the boosted power to a load, and to an electronic apparatus that includes the boost controller.

2. Description of the Related Art

Light-emitting diodes (LED) of various types are used in battery-driven portable equipment such as cell phones and personal data assistants (PDA). For example, an LED is used as backlight for a liquid crystal display (LCD). Lithium-ion batteries are commonly used in battery-driven portable equipment. A lithium-ion battery generates a battery voltage of about 3.1-4.2V. A white LED requires a driving voltage of about 3.3-4.0V. Therefore, a charge pump circuit is required to boost the battery voltage. Patent document No. 1 discloses a method of controlling a charge-pump regulated dc-dc converter.

Patent document No. 1

Japanese Published Patent Application No. 10-215564

Patent document No. 1 describes automatic control performed by detecting the magnitude of an output current. When the step-up ratio is varied only by monitoring an output current, however, the step-up ratio is changed regardless of a voltage drop in a load such as an LED. Accordingly, significant battery loss is incurred.

SUMMARY OF THE INVENTION

The present invention has been done in view of the aforementioned circumstances and its object is to extend the battery life in an apparatus for boosting a battery voltage and supplying the boosted voltage to a load.

The present invention according to one aspect provides a boost controller. The boost controller according to this aspect comprises: a boost circuit which boosts a given voltage so as to generate a voltage for driving a target load; a constant current circuit which generates a constant current to feed through the load; a monitoring circuit which monitors a voltage across the constant current circuit; and a control circuit which controls a step-up ratio of the boost circuit, wherein, when it is found as a result of monitoring by the monitoring circuit that the voltage across the constant current circuit is below a minimum voltage that guarantees a constant current, the control circuit increases the step-up ratio of the boost circuit.

According to this boost controller, by monitoring the voltage across the constant current circuit instead of monitoring a battery voltage or an output voltage of the boost circuit, it is ensured that the step-up ratio is increased when the load is not driven by a constant current, regardless of the magnitude of voltage drop across the load such as an LED. Accordingly, the battery power supply can be used efficiently so that the battery life is extended. For example, even when the output voltage of the boost circuit drops, the step-up ratio is not changed when the voltage drop across the load is small. The given voltage boosted could be the output voltage of the boost circuit instead of the battery voltage. The boost circuit could be a negative boost circuit.

The control circuit may be given an externally supplied instruction requesting a constant current value that the constant current circuit should generate, so as to set a requested current value in the constant current circuit. The control circuit lowers the step-up ratio of the boost circuit when a change from a relatively large current to a relatively small current is requested by the instruction. By lowering the step-up ratio when a change from a large constant current to a small constant current is requested by an externally supplied instruction, i.e., when the magnitude of voltage drop due to a drive current for driving the load is decreased, relatively stable operation of the controller is achieved.

The monitoring circuit may determine whether a load is connected before monitoring the constant current circuit, and does not perform monitoring of the constant current circuit associated with the load when the load is not connected. It is ensured that the monitoring circuit detects a failure when the load is not connected so that undesired increase in the step-up ratio is prevented. By allowing the monitoring circuit to double as a circuit for this determination, the circuit is simplified.

The monitoring circuit may suspend monitoring of the voltage across the constant current circuit when it is found that the voltage across the constant current circuit is below the minimum voltage in a predetermined period of time at start-up of the boost circuit.

The present invention according to another aspect provides a boost controller. The boost controller according to this aspect comprises a boost circuit which boosts a battery voltage so as to generate a voltage for driving a target load; a constant current circuit which generates a constant current to feed through the load; a monitoring circuit which monitors a voltage across the constant current circuit; a control circuit which controls a step-up ratio of the boost circuit; and a protection circuit which monitors an output voltage of the boost circuit, wherein, when it is found as a result of monitoring by the monitoring circuit that the voltage across the constant current circuit is below a minimum operating voltage, the control circuit increases the step-up ratio of the boost circuit and the protection circuit detects, in a period for control of the step-up ratio by the monitoring circuit and the control circuit, a failure in a system including the controller and the target load, from a result of monitoring of the output voltage of the boost circuit.

With this, when it is found that the output voltage of the boost circuit drops below a predetermined voltage, a determination is made that a failure, such as destruction of the load or grounding of the output of the boost circuit, occurs. Such a situation can be addressed by returning the step-up ratio to 1 or bringing the controller to a standby state. Accordingly, the controller can be protected.

The boost circuit may fix the output voltage by feeding back the output. When the output voltage is fixed, the maximum voltage is fixed. This eliminates the need for design processes for a withstand voltage higher than the maximum voltage. Accordingly, the circuit is simplified. Since this allows the voltage applied to the load to be constant, durability of the load is improved.

The boost controller may further comprise a voltage regulating unit which regulates an input voltage of the boost circuit so that the output voltage of the boost circuit approximates a predetermined reference voltage.

The voltage regulating unit may comprise an error amplifier which amplifies an error between the output voltage of the boost circuit and the reference voltage; and a transistor which has its on resistance controlled by an output voltage of the error amplifier.

The boost circuit may fix the output voltage by feeding back the output. When the output voltage is fixed, the maximum voltage is fixed. This eliminates the need for design processes for a withstand voltage higher than the maximum voltage. Accordingly, the circuit is simplified. Since this allows the voltage applied to the load to be constant, durability of the load is improved.

The present invention according to still another aspect also provides an electronic apparatus. The electronic apparatus according to this aspect comprises: a boost controller according to any of the aspects described above; and a light-emitting element driven by the boost controller. With this, the light-emitting element is lighted by using the battery efficiently.

It is to be noted that any arbitrary combination or rearrangement of the above-described structural components and so forth are all effective as and encompassed by the present embodiments. Moreover, this summary of the invention does not necessarily describe all necessary features so that the invention may also be sub-combination of these described features.

BRIEF DESCRIPTION OF THE DRAWINGS

FIG. 3 is a table for explaining the process in a current control unit.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

Figure 1:
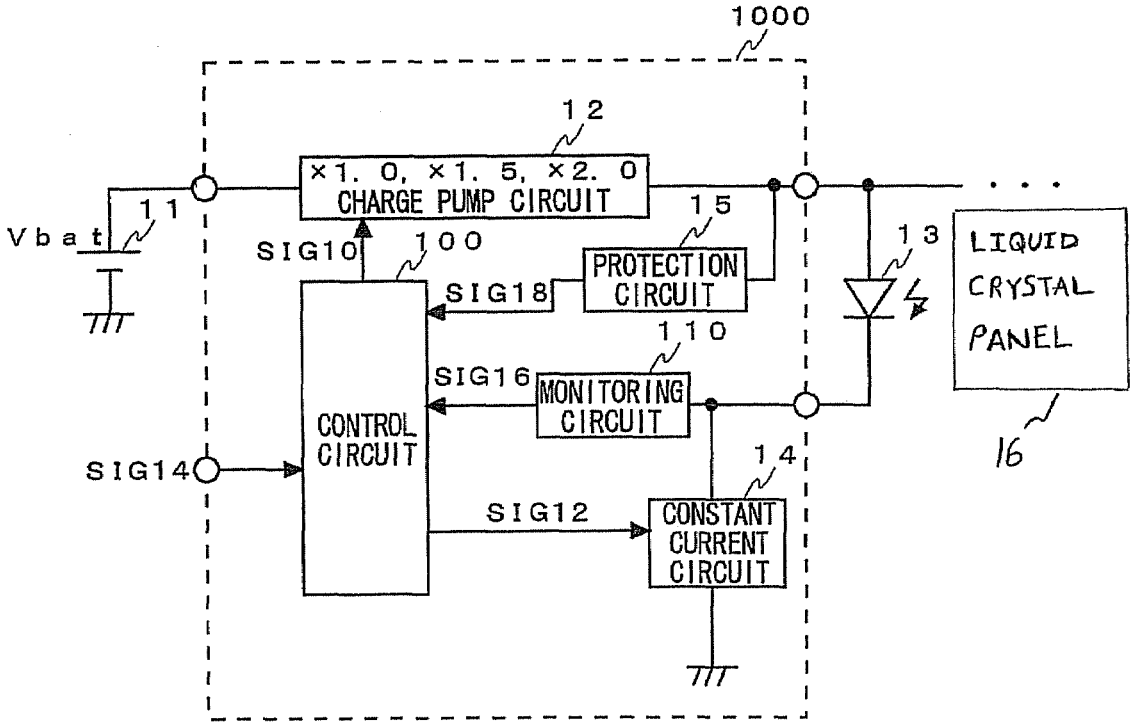
FIG. 1 is a block diagram illustrating the basic structure of a boost controller according to an embodiment.

FIG. 1 is a block diagram illustrating the basic structure of a boost controller according to an embodiment. The boost controller is built in a battery-driven electronic apparatus such as a cell phone and a PDA. The boost controller controls the step-up ratio applied to a battery voltage Vbat of, for example, a lithium-ion battery, which is boosted and then supplied to a load such as an LED 13.

A boost controller 1000 includes a charge pump circuit 12, a control circuit 100, a monitoring circuit 110, a constant current circuit 14 and a protection circuit 15.

A battery 11 implemented by a lithium-ion battery generates a battery voltage Vbat of 3.1-4.2V. The charge pump circuit 12 is provided with a plurality of switching elements, a boost capacitor and an output capacitor. The charge pump circuit 12 boosts the battery voltage Vbat by a predetermined step-up ratio. In this embodiment, the charge pump circuit 12 is provided with two external capacitors and is operated at one of three modes including a ×1.0 mode, a ×1.5 mode and a ×2.0 mode in accordance with an instruction from the control circuit 100. The charge pump circuit 12 supplies the boosted voltage to the LED 13.

The LED 13 is driven by the voltage supplied from the charge pump circuit 12 to emit light. The LED 13 is used as backlight for a liquid crystal panel 16. In the case of a white LED, a voltage drop of 3.3-4.0V occurs. The voltage drop varies depending on a drive current or an environmental temperature. The LED is driven by a constant current in order to prevent flicker and to maintain constant luminance. Therefore, the LED is subject to a constant-current control by the constant current circuit 14. When the constant-current control is applied, long-lasting light emission of the LED 13 is enabled and the life thereof is extended. While FIG. 1 only shows one LED, there may be provided a plurality of LEDs. LEDs emitting a variety of colors as well as a white LED may also be used. In this case, the step-up ratio set up in the charge pump circuit 12 may be different.

The constant current circuit 14 controls the LED 13 so that a constant current flows in the LED 13. The constant current circuit 14 switches between constant current values in accordance with an instruction signal SIG12 from the control circuit 100. For example, the instruction requests constant current values like 1 mA, 10 mA, 15 mA and 20 mA. A current setting signal SIG14 for obtaining desired luminance is fed to the control circuit 100 from outside the controller. When a change in luminance is requested by the control circuit 100, the constant current value is changed accordingly. In this embodiment, the constant current circuit 14 is operated normally when a voltage of 0.3 or above is supplied. That is, 0.3V is a minimum voltage that guarantees a constant current. When a voltage below 0.3V is supplied, constant current control cannot be performed. The minimum voltage corresponds to a voltage in which it is ensured that a transistor used inside the constant current circuit 14 does not saturate.

The monitoring circuit 110 monitors a voltage between the cathode of the LED 13 and GND, i.e., a voltage across the constant current circuit 14. The monitoring circuit 110 informs the control circuit 100 of the monitoring result by a monitoring signal SIG16. The voltage at the cathode of the LED 13 is a residual voltage that remains after subtracting the voltage drop across the LED 13 from the output voltage of the charge pump circuit 12. In this embodiment, the monitoring circuit 110 monitors to determine whether the residual voltage drops below 0.3V. When the voltage drops below 0.3V, the monitoring circuit 110 informs the control circuit 100 of voltage shortage. This is because, when the voltage drops below 0.3V, the constant current circuit 14 cannot operate normally and the LED 13 cannot be driven by a constant current. More specifically, flicker or insufficient luminance occurs.

The protection circuit 15 monitors the output voltage of the charge pump circuit 12. The protection circuit 15 detects a failure in a system including the boost controller 1000 and the LED 13 as a load, by referring to the result of monitoring the output voltage, in a period for control of the step-up ratio by the monitoring circuit 110 and the control circuit 100, the protection circuit detects a failure.

When the output voltage of the charge pump circuit 12 drops below 1.0V for a duration of 10 ms, the protection circuit 15 informs the control circuit 100 accordingly by a failure report signal SIG18.

The control circuit 100 controls the step-up ratio of the charge-pump circuit 12 based on the information from the monitoring circuit 110 and the externally supplied current setting signal SIG14 for luminance regulation. Initially, the control circuit 100 sets the step-up ratio of the charge pump circuit 12 to 1.0. When the control circuit 100 finds that the cathode potential of the LED 13 drops below 0.3V by referring to the information from the monitoring circuit 110, the control circuit 100 changes the step-up ratio of the charge pump circuit 12 to 1.5. When the control circuit 100 finds, by referring to the information from the monitoring circuit 110, that the cathode potential of the LED 13 remains below 0.3V in a state in which the step-up ratio of the charge pump circuit 12 is 1.5, the control circuit 110 changes the step-up ratio to 2.0. The same operation is applied when the cathode potential returns to a level equal to or above 0.3V temporarily and then drops below 0.3V again.

The control circuit 100 changes the current that flows in the LED 13 by directing the constant current circuit 14 to supply a constant current of a value corresponding to the change. When the externally supplied current setting signal SIG14 for luminance regulation requests a change from a large current to a small current, and when the charge pump circuit 12 is operating in a ×1.5 mode or a ×2.0 mode, the control circuit 100 changes the step-up ratio of the charge pump circuit 12 to 1.0. By ensuring that the return of the step-up ratio of the charge pump circuit 12 to 1.0 occurs only when the drive current of the LED 13 is changed from a large current to a small current, stable operation is achieved. More specifically, even when some period of time elapses after the cathode potential of the LED 13 grows to a level equal to or larger than 0.3V in a situation where the step-up ratio of the charge pump circuit 12 is increased to 1.5 or 2.0, the step-up ratio of the charge pump circuit 12 is not returned to 1.0 immediately. This is because the cathode potential of the LED 13 may immediately drop below 0.3V. The likelihood of the cathode potential dropping below 0.3V is reduced only when the drive current of the LED 13 is changed from a large current to a small current.

Further, the control circuit 100 makes a transition to a short circuit protect error mode described later when it is informed of a failure by the failure report signal SIG18 from the protection circuit 15.

Figure 2:
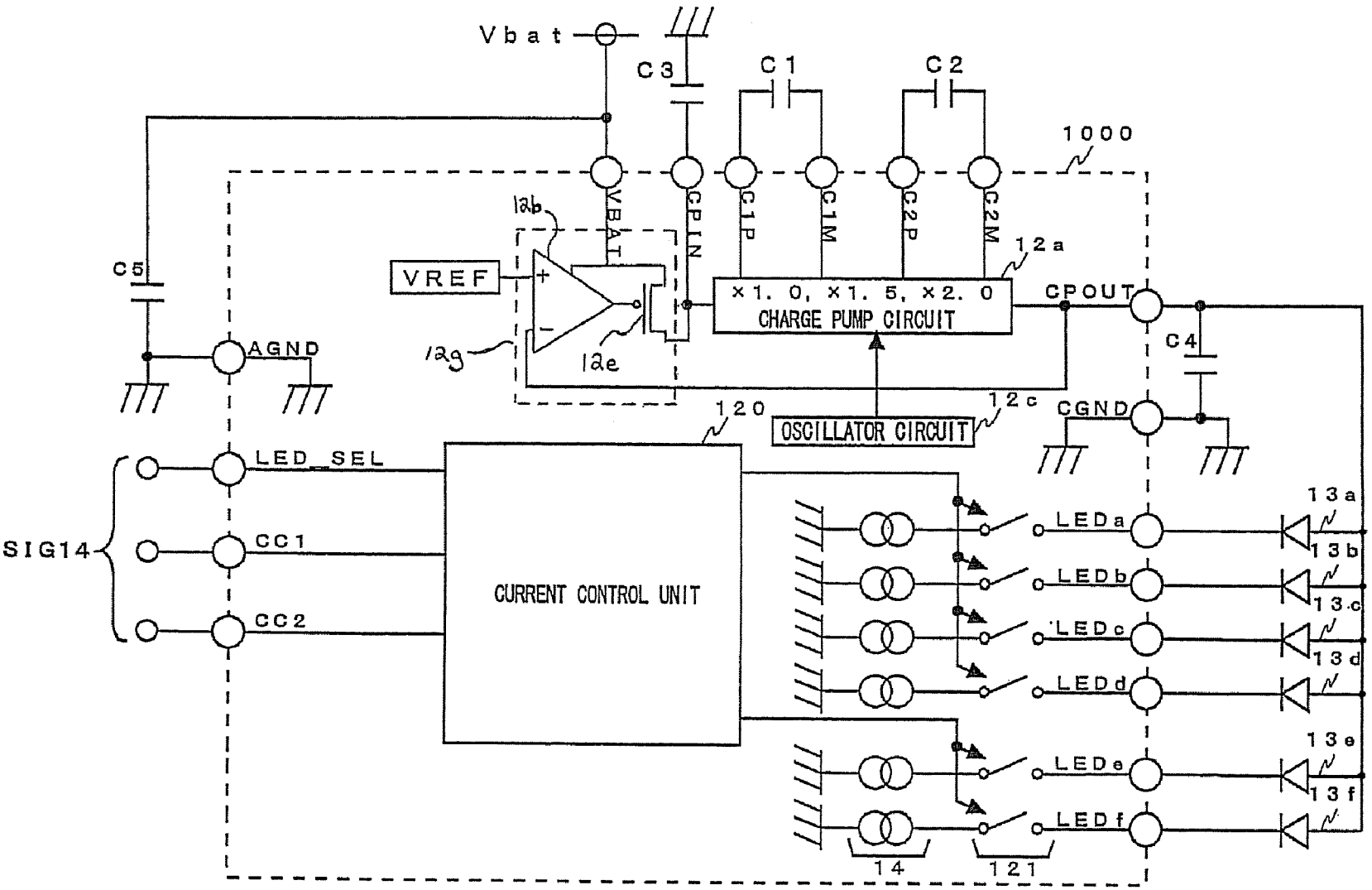
FIG. 2 is a block diagram illustrating the basic structure of an integrated boost controller.

A description will be given of an example where the above-described boost controller is implemented by an IC chip. FIG. 2 is a block diagram illustrating the structure of the boost controller implemented by an IC chip. The IC chip is an integration of the charge pump circuit 12 excluding the external capacitor illustrated in FIG. 1, the constant current circuit 14, the control circuit 100 and the monitoring circuit 110. The control circuit 100, the monitoring circuit 110 and the protection circuit 15 are omitted from FIG. 2 for simplified illustration.

A voltage regulator circuit 12*g* includes an inverting amplifier implemented by a differential amplifier 12*b* and constitutes a regulator circuit together with a built-in transistor 12*e*. The voltage regulator circuit 12*g* is operated by being supplied with a voltage from a battery 11 via VBAT terminal of the IC chip, applies a voltage drop to the battery voltage Vbat using the built-in transistor 12*e*, and supplies the dropped voltage to the charge pump circuit 12*a*.

The voltage regulator circuit 12*g* compares a voltage obtained by dividing an output voltage of the charge pump circuit 12*a* and a reference voltage VREF so as to control an input voltage of the charge pump circuit 12*a* such that a difference between the compared pair is nil. In this embodiment, the reference voltage VREF is set to 1.2V. Between the voltage regulator circuit 12*g* and the charge pump circuit 12*a* is connected a phase compensation capacitor C3 via CPIN terminal. AGND terminal is for grounding the IC chip.

Two boost capacitors C1 and C2 are connected to the charge pump circuit 12*a* via C1P terminal, C1M terminal, C2P terminal and C2M terminal. A switching element is coupled to the boost capacitors C1 and C2, the phase compensation capacitor C3 and an output capacitor C4. The charge pump circuit 12*a* uses a pulse supplied from an oscillator circuit 12*c* so as to perform on and off of control of the switching elements. The step-up ratio of the charge pump circuit 12*a* is controlled to be 1.5 or 2.0 by controlling the charge status of the capacitors C1 and C2 according to a predetermined pattern. The oscillator circuit 12C generates a pulse of a preset frequency and supplies the pulse to the charge pump circuit 12*a*. In this embodiment, the output voltage of the charge pump circuit 12*a* is fixed at 4.5V. The output voltage is fed back to the voltage regulator circuit 12*g*. When the output voltage exceeds 4.5V, the output voltage of the voltage regulator circuit 12*g* is lowered by control. When the output voltage of the charge pump circuit 12*a* drops below 4.5V, the output voltage of the voltage regulator 12*g* is increased by control. The output of the charge pump circuit 12*a* is charged in the output capacitor C4 via CPOUT terminal and supplied to an LED group 13. CGND terminal is for grounding the charge pump circuit 12*a*. The present invention is not limited to a charge pump of a feedback type but is applicable to charge pump of a non-feedback type.

The step-up ratio of the charge pump circuit 12*a* is subject to switching control as described below. When the step-up ratio is 1.0, the switching element provided between an input terminal and an output terminal of the charge pump circuit 12*a* is turned on.

When the step-up ratio is 2.0, the boost capacitors C1 and C2 in a first state are connected in parallel and are charged by the input voltage of the charge pump circuit 12*a*. In a second state, the boost capacitors C1 and C2, charged by the input voltage, are connected between the input terminal and the output terminal of the charge pump circuit 12*a*. By alternately repeating the first state and the second state, a voltage twice the input voltage is output from the output terminal of the charge pump circuit 12.

When the step-up ratio is 1.5, the boost capacitors C1 and C2 in a first state are connected in series and are charged by the input voltage of the charge pump circuit 12*a*. In this state, the capacitors C1 and C2 are charged by a voltage ½ of the input voltage of the charge pump circuit 12*a*. In a second state, the boost capacitors C1 and C2 thus charged are connected in parallel between the input terminal and the output terminal of the charge pump circuit 12*a*. By alternately repeating the first state and the second state, a voltage 1.5 times the input voltage is output from the output terminal of the charge pump circuit 12.

The LED group 13 comprises a plurality of individual LEDs. In the embodiment, four main LEDs 13*a*-13*d* and two sub-LEDs 13*e* and 13*f* are provided. A voltage of 4.5V is supplied to the anode of each of the LEDs 13*a*-13*f*. The constant current circuit 14 is connected to each of the LEDs 13*a*-13*f* via a corresponding one of switches 121. The LEDs 13*a*-13*f* are each driven by a constant current and emits a light with a constant luminance. The voltage drop applied in the LEDs 13*a*-13*f* is irregular since it is affected by the drive current and the environmental temperature.

Terminals LEDa-LEDf are for monitoring the cathode potential subjected to voltage drop in the LEDs 13*a*-13*f*. The terminals LEDa-LEDf are monitored to detect whether the potential at any of the terminals drops below 0.3V. The constant current circuit 14 is provided for each of the LEDs 13*a*-13*f*. A current controller 120 controls a current that flows through each of the LEDs 13*a*-13*f* to be at a predetermined constant level. Switches 121 are operated for on and off control of the LEDs for light emission. The current that flows in each of the main LEDs and the sub-LEDs is set by the constant current circuit 14 at a level selected from the levels of 1 mA, 10 mA, 15 mA and 20 mA. Finer current setting is possible. Channel to channel, i.e., LED to LED, independent current setting is also possible.

LED_SEL terminal, CC1 terminal and CC2 terminal are current control terminals for receiving an externally supplied current control instruction. A digital value is fed via each of these terminals to the current control unit 120. The current control unit 120 controls the constant current circuit 14 in accordance with a combination of the digital values input via the terminals so as to generate a constant current.

FIG. 3 is a table illustrating an example of current control by the current control unit 120. When a low level occurs at all of LED_SED terminal, CC1 terminal and CC2 terminal, the LEDs 13*a*-13*f* are all turned off and are in a standby state. For example, when a high level occurs at CC2 terminal, the current control unit 120 allows a constant current of 1 mA to through the sub-LEDs 13*e*-13*f*. Thus, current control is performed in accordance with a combination of the externally supplied digital signals input to the three terminals.

Figure 4:
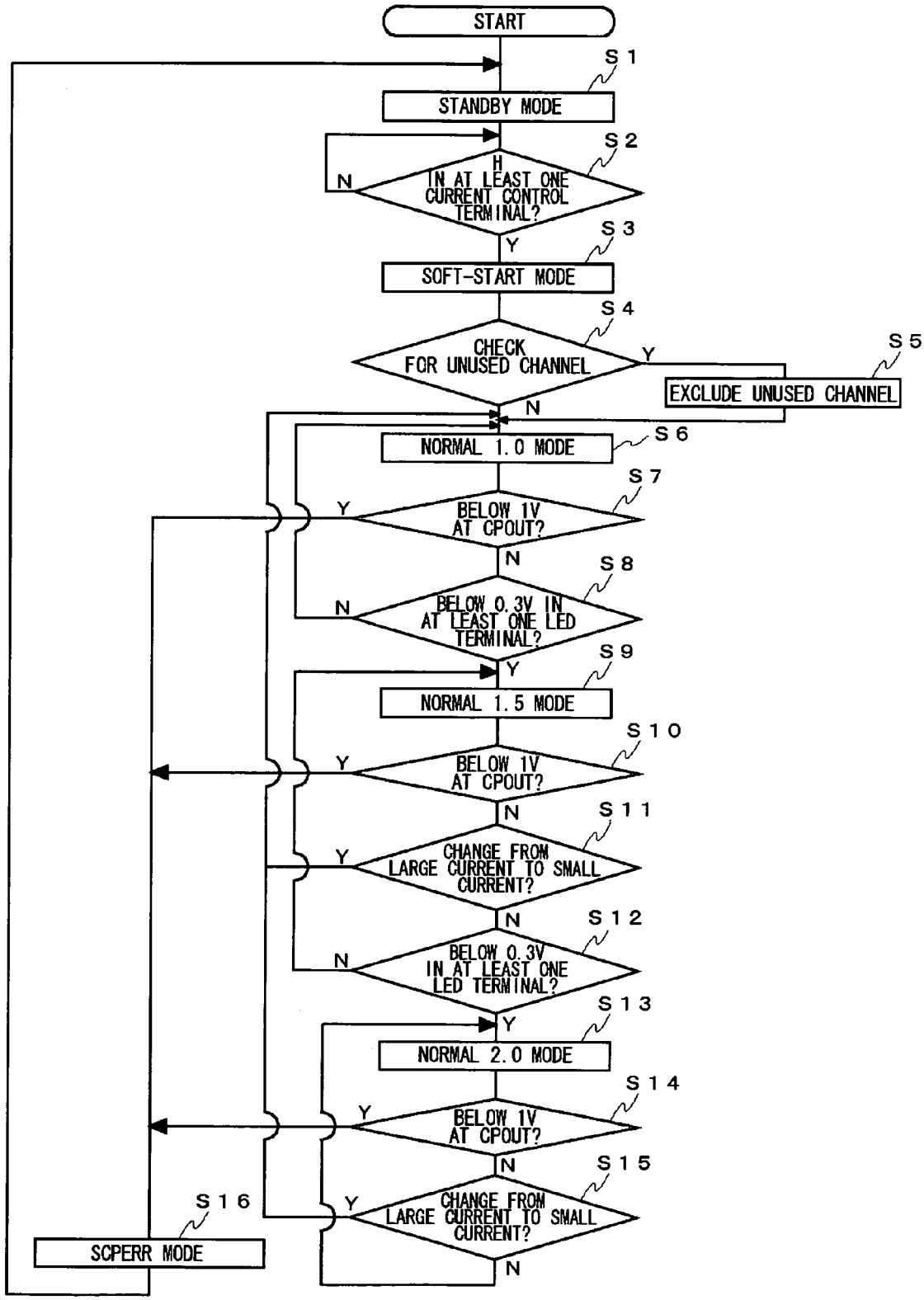
FIG. 4 is a flowchart for explaining the operation of a boost controller.

A description will now be given of the operation of the boost controller illustrated in FIG. 2. FIG. 4 is a flowchart explaining the operation of the boost controller. When a low level occurs at all of the three current control terminals LED_SEL, CC1 and CC2, the IC is in a standby mode (S1). When one of the three current control terminals goes high (Y of S2), the IC makes a transition to a soft-start mode (S3).

In a soft-start mode, the IC waits until 2 ms elapses in order to prevent an inrush current to the phase compensation capacitor C3 connected to CPIN terminal. 2 ms is a preset period of time. In this mode, the step-up ratio of the charge pump circuit 12*a* is set to 1.0. In this period of time, the voltage at each of the terminals LEDa-LEDf is monitored (S4). When a voltage below 0.3V is detected in at least one of the terminals LEDa-LEDf (Y of S4), the terminal in which the detection occurs is identified as a terminal for unused channel. In a subsequent process for mode switching, the terminal for unused channel is excluded from monitoring (S5). That terminal for unused channel is latched in the current state. Without this process, the step-up ratio continues to be automatically increased in the subsequent process. The user may ground the terminal for unused channel. In this way, the terminal for unused channel is excluded from monitoring.

After 2 ms elapses, the IC makes an automatic transition from a soft-start mode to a normal ×1.0 mode (S6). In this mode, the step-up ratio of the charge pump circuit 12*a* is set to 1.0. The protection circuit 15 of the boost controller 1000 monitors the voltage at CPOUT terminal at which the output voltage of the charge pump circuit 12*a* occurs (S7). When the voltage at the CPOUT is maintained at a level be below 1.0V for a duration of 10 ms (S7/YES), the IC makes a transition to a short circuit protect error mode (S16).

Concurrently, the monitoring circuit 110 of the boost controller 1000 monitors the voltage at each of the LEDa-LEDf (S8) When a voltage below 0.3V occurs at any of the terminals LEDa-LEDf for a duration of 2 ms (Y of S8), the IC automatically makes a transition from the normal ×1.0 mode to a normal ×1.5 mode (S9). In the 2 ms duration, a digital filter is applied. The above-mentioned procedure is to exclude from monitoring a case where a momentary undershoot current occurs and the terminal voltage drops below 0.3V. The temporary non-operation of the LEDs 13*a*-13*f* is not recognized by the human eye and therefore need not be detected. When the voltage at CPOUT terminal does not drop below 1.0V (N of S7), and when a voltage of 0.3V or larger occurs at all of the terminals LEDa-LEDf (N of S8), the normal ×1.0 mode is maintained (S6).

The step-up ratio of the charge pump circuit 12*a* is maintained to be 1.5 during the normal ×1.5 mode. The protection circuit 15 of the boost controller 1000 monitors the voltage at CPOUT terminal at which the output voltage of the charge pump circuit 12*a* occurs (S10). When the voltage at CPOUT terminal is below 1.0V for a duration of 10 ms (Y of S10), the IC makes a transition to a short circuit protect error mode (S16). Concurrently, the control circuit 100 of the boost controller 1000 monitors the current control terminals (S11). When a change from a large current to a small current is requested (Y of S11), the IC makes a transition to the normal ×1.0 mode (S6). The control circuit 100 may determine that a change from a large current to a small current is requested when the level changes from high to low at LED_SEL terminal or CC1 terminal.

Concurrently, the monitoring circuit 110 of the boost controller 1000 monitors all of the terminals LEDa-LEDf (S12). When a voltage below 0.3V occurs at any of the terminals LEDa-LEDf for a duration of 2 ms (S12/Y), the IC automatically makes a transition from the normal ×1.5 mode to a normal ×2.0 mode (S13). When (1) the voltage at CPOUT terminal does not drop below 1.0V (N of S10), (2) there is not a request for a change from a large current to a small current (N of S11), and (3) a voltage of 0.3V or larger occurs at all of the terminals LEDa-LEDf (N of S12), the normal ×1.5 mode is maintained (S9).

The step-up ratio of the charge pump circuit 12*a* is maintained to be 2.0 during the normal ×2.0 mode. The control circuit 100 monitors the voltage at CPOUT terminal at which the output voltage of the charge pump circuit 12*a* occurs (S14). When the voltage at CPOUT terminal is below 1.0V for a duration of 10 ms (Y of S14), the IC makes a transition to a short circuit protect error mode (S16). Concurrently, the control circuit 100 monitors the current control terminals (S15). When a change from a large current to a small current is requested (Y of S15), the IC makes a transition to the normal ×1.0 mode (S6). When the voltage at CPOUT terminal does not drop below 1.0V (N of S14) and when there is not a request for a change from a large current to a small current (N of S15), the normal ×2.0 mode is maintained (S13).

The short circuit protect error mode is a mode applied when it is determined that mechanical destruction such as a short circuit between terminals of an LED or an error such as grounding of CPOUT terminal occurs (S16). In this mode, the operation of the charge pump circuit 12*a* is suspended. Since the charge pump circuit 12*a* is of high current capability, a large current flows as a result of short circuit, causing significant loss. In a soft-start mode, monitoring is not performed since a drop in the voltage at CPOUT terminal is not a failure. Monitoring is started once the normal ×1.0 mode is started. In the short circuit protect error mode, the IC makes a transition to a standby mode after a period of 100 ms elapses (S1).

Described above is an explanation based on the embodiment. The embodiment of the present invention is only illustrative in nature and it will be obvious to those skilled in the art that various variations in constituting elements and processes are possible within the scope of the present invention.

Figure 5:
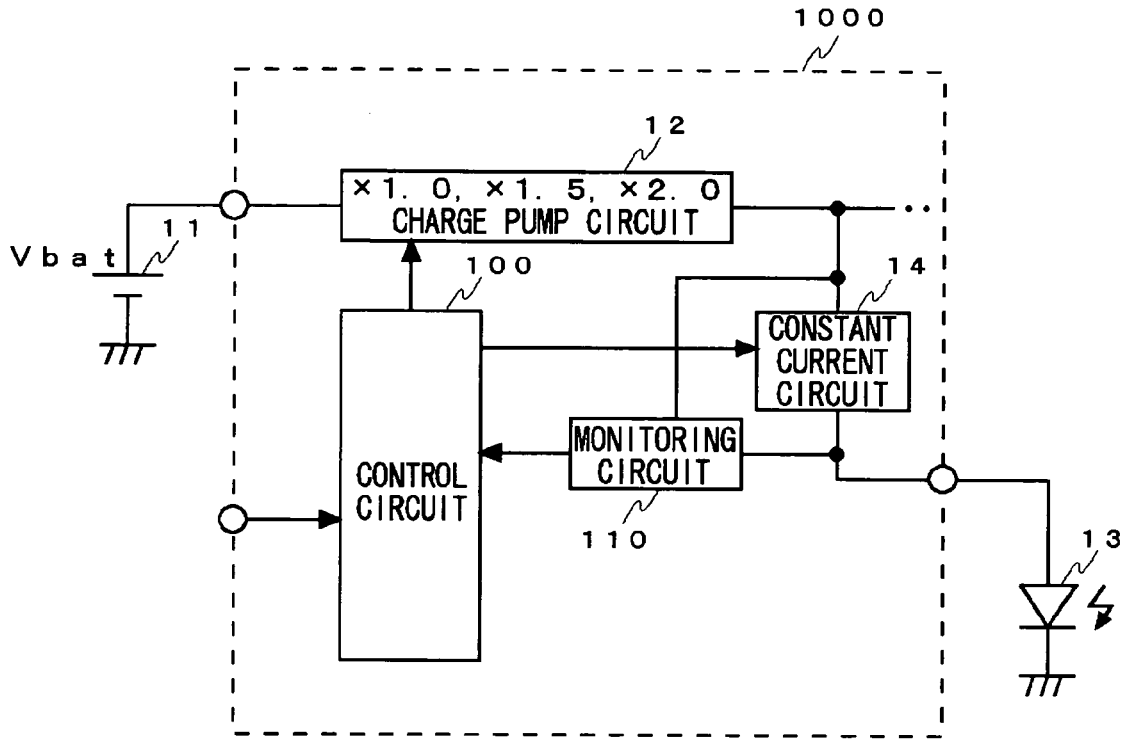
FIG. 5 is a block diagram illustrating the structure of a boost controller according to a first variation.

FIG. 5 illustrates the structure of a boost controller according to a first variation. In the first variation, the positions of the constant current circuit 14 and the LED 13 are interchanged. The monitoring circuit 110 monitors a voltage across the constant current circuit 14 so as to detect whether the voltage drops below a minimum voltage that guarantees a constant current. The other aspects of the variation are the same as the corresponding aspects of the embodiment described above.

Figure 6:
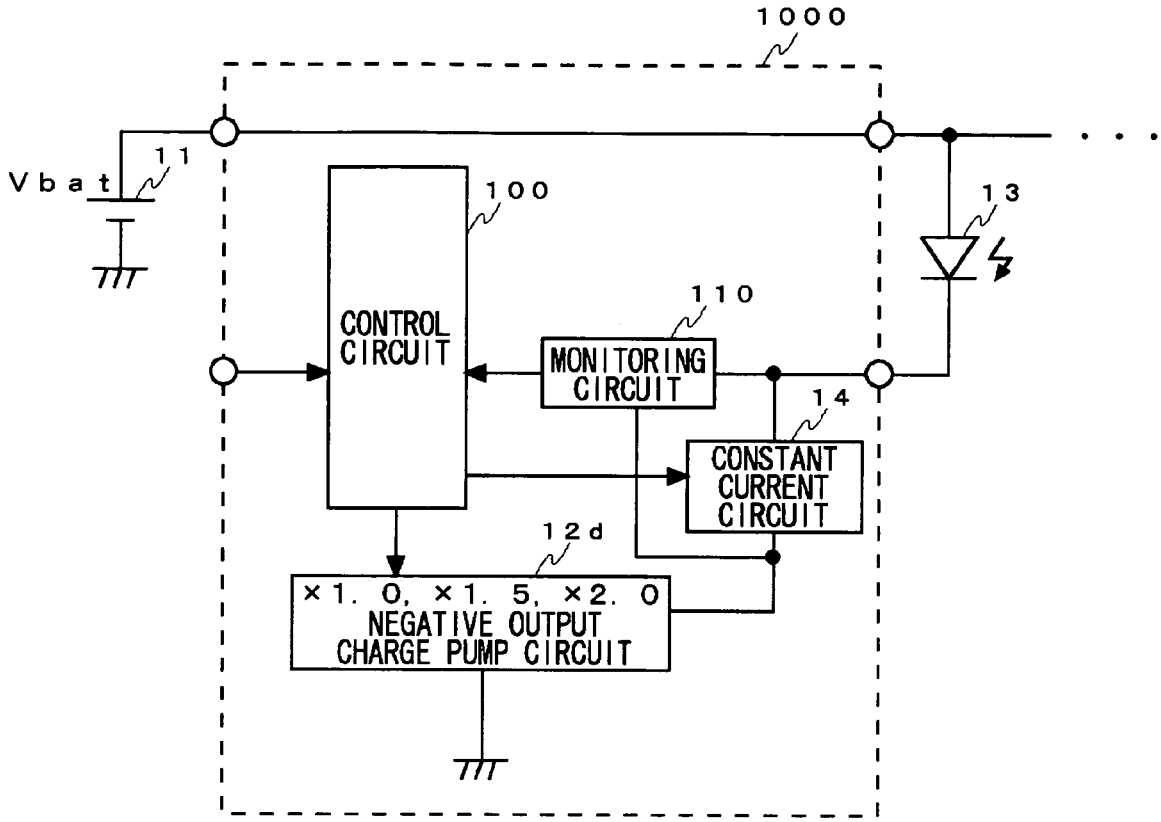
FIG. 6 is a block diagram illustrating the structure of a boost controller according to a second variation.

FIG. 6 illustrates the structure of a boost controller according to a second variation. In the second variation, instead of providing the charge pump circuit 12 between the battery 11 and the LED 13, a negative output charge pump circuit 12*d* is provided in a stage subsequent to the constant current circuit 14. The monitoring circuit 110 monitors the voltage across the constant current circuit 14 so as to detect whether the voltage drops below a minimum voltage that guarantees a constant current. When a drop below the minimum voltage is detected, the monitoring circuit 110 informs the control circuit 100 accordingly. The control circuit 100 controls the negative output charge pump circuit 12*d* so as to lower the output of the constant current circuit 14. In this process, the control circuit 100 controls the voltage across the constant current circuit 14 to a level within a voltage range that guarantees a constant current. A difference from the embodiment described above resides in inversion in the control of step-up ratio, the other aspects remaining the same as the corresponding aspects already described.

When the LED 13 is subject to pulse width modulation (PWM) control, the monitoring circuit 110 performs monitoring only while the LED 13 is turned on.

What is claimed is:

1. A boost controller comprising:

a boost circuit which boosts a given voltage so as to generate a voltage for driving a target load;

a constant current circuit which generates a constant current to feed through the load;

a monitoring circuit which monitors a voltage across the constant current circuit;

a terminal to which a setting signal instructing the constant current value is supplied; and a control circuit which controls a step-up ratio of the boost circuit based on the setting signal and signal from the monitoring circuit, wherein when it is found as a result of monitoring by the monitoring circuit that the voltage across the constant current circuit is below a minimum voltage that guarantees a constant current, the control circuit increases the step-up ratio of the boost circuit.

2. The boost controller according to claim 1, wherein the control circuit is given an externally supplied instruction requesting a constant current value that the constant current circuit should generate so as to set a requested current value in the constant current circuit, and lowers the step-up ratio of the boost circuit when a change from a relatively large current to a relatively small current is requested by the instruction.

3. The boost controller according to claim 1, wherein the monitoring circuit determines whether the load is connected before monitoring the constant current circuit, and does not perform monitoring of the constant current circuit associated with the load when the load is not connected.

4. The boost controller according to 2, wherein the monitoring circuit determines whether the load is connected before monitoring the constant current circuit, and does not perform monitoring of the constant current circuit associated with the load when the load is not connected.

5. The boost controller according to claim 1, wherein the monitoring circuit suspends monitoring of the voltage across the constant current circuit when it is found that the voltage across the constant current circuit is below the minimum voltage in a predetermined period of time at start-up of the boost circuit.

6. The boost controller according to claim 2, wherein the monitoring circuit suspends monitoring of the voltage across the constant current circuit when it is found that the voltage across the constant current circuit is below the minimum voltage in a predetermined period of time at start-up of the boost circuit.

7. The boost controller according to claim 1, further comprising a protection circuit which monitors an output voltage of the boost circuit, wherein in a period for control of the step-up ratio by the monitoring circuit and the control circuit, the protection circuit detects a failure in a system including the controller and the target load, from a result of monitoring of the output voltage.

8. The boost controller according to claim 2, further comprising a protection circuit which monitors an output voltage of the boost circuit, wherein in a period for control of the step-up ratio by the monitoring circuit and the control circuit, the protection circuit detects a failure of a system including the controller and the target load, from a result of monitoring of the output voltage.

9. The boost controller according to claim 1, further comprising a voltage regulating unit which regulates an input voltage of the boost circuit so that the output voltage of the boost circuit approximates a predetermined reference voltage.

10. The boost controller according to claim 9, wherein the voltage regulating unit comprises:

a differential amplifier which amplifies an error between the output voltage of the boost circuit and the reference voltage; and a transistor having a direct current voltage applied to one end thereof and having its other end connected to an input terminal of the boosting circuit, the transistor having its on resistance controlled by an output voltage of the differential amplifier and supplying a dropped voltage derived from lowering the direct current voltage to the boosting circuit.

11. An electronic apparatus comprising:

a boost controller; and a light-emitting element driven by the boost controller; wherein the boost controller comprises:

a boost circuit which boosts a given voltage so as to generate a voltage for driving a target load;

a constant current circuit which generates a constant current to feed through the load;

a monitoring circuit which monitors a voltage across the constant current circuit; a terminal to which a setting signal instructing the constant current value is supplied; and a control circuit which controls a step-up ratio of the boost circuit based on the setting signal and a signal from the monitoring circuit, wherein when it is found as a result of monitoring by the monitoring circuit that the voltage across the constant current circuit is below a minimum voltage that guarantees a constant current, the control circuit increases the step-up ratio of the boost circuit.

12. The electronic apparatus according to claim 11, further comprising a liquid crystal panel operated by using the light-emitting element as backlight.

13. An electronic apparatus comprising:

a boost controller; and a light-emitting element driven by the boost controller; wherein the boost controller comprises:

a boost circuit which boosts a given voltage so as to generate a voltage for driving a target load;

a constant current circuit which generates a constant current to feed through the load;

a monitoring circuit which monitors a voltage across the constant current circuit; a terminal to which a setting signal instructing the constant current value is supplied; and a control circuit which controls a step-up ratio of the boost circuit based on the setting signal and a signal from the monitoring circuit, wherein when it is found as a result of monitoring by the monitoring circuit that the voltage across the constant current circuit is below a minimum voltage that guarantees a constant current, the control circuit increases the step-up ratio of the boost circuit, and wherein the control circuit is given an externally supplied instruction requesting a constant current value that the constant current circuit should generate so as to set a requested current value in the constant current circuit, and lowers the step-up ratio of the boost circuit when a change from a relatively large current to a relatively small current is requested by the instruction.

14. The electronic apparatus according to claim 13, further comprising a liquid crystal panel operated by using the light-emitting element as backlight.

* * * * *